US007556477B2

(12) United States Patent
Sherlock et al.

(10) Patent No.: US 7,556,477 B2
(45) Date of Patent: Jul. 7, 2009

(54) BI-LAYER TIP CAP

(75) Inventors: Graham D. Sherlock, Greenville, SC (US); Daniel A. Nowak, Greenville, SC (US); Stephen J. Balsone, Simpsonville, SC (US); Patrick J. Mohr, Greer, SC (US)

(73) Assignee: General Electric Company, Schenectady, NY (US)

( * ) Notice: Subject to any disclaimer, the term of this patent is extended or adjusted under 35 U.S.C. 154(b) by 542 days.

(21) Appl. No.: 11/163,067

(22) Filed: Oct. 4, 2005

(65) Prior Publication Data

US 2007/0077143 A1 Apr. 5, 2007

(51) Int. Cl.
*F01D 5/28* (2006.01)

(52) U.S. Cl. ..... 416/224; 416/228

(58) Field of Classification Search ..... 416/224, 416/228

See application file for complete search history.

(56) References Cited

U.S. PATENT DOCUMENTS 3,785,809 A * 1/1974 Cox ..... 420/448
3,899,267 A * 8/1975 Dennis et al. ..... 416/228
4,020,538 A * 5/1977 Dennis et al. ..... 29/889.721
4,247,254 A * 1/1981 Zelahy ..... 416/97 R
4,390,320 A * 6/1983 Eiswerth ..... 416/92
4,411,597 A * 10/1983 Koffel et al. ..... 416/92
4,421,153 A * 12/1983 Wilkinson et al. ..... 164/35
4,540,339 A * 9/1985 Horvath ..... 416/92
4,589,824 A * 5/1986 Kozlin ..... 416/232
4,802,828 A * 2/1989 Rutz et al. ..... 416/241 B
5,359,770 A * 11/1994 Brown et al. ..... 416/224
6,231,307 B1 5/2001 Correia ..... 416/97 R
2003/0082054 A1 * 5/2003 Grylls et al. ..... 416/224

OTHER PUBLICATIONS

Title: "NIMONIC alloy 263", Special Metals, 12 pgs.
Title: "Haynes 230 Alloy", Haynes International, 28 pgs.

* cited by examiner

*Primary Examiner*—Richard Edgar
(74) *Attorney, Agent, or Firm*—Sutherland Asbill & Brennan LLP

(57) ABSTRACT

A tip cap for use in a turbine bucket. The tip cap may include a shield of an oxidant resistant material and a cap positioned within the shield of a high strength material.

17 Claims, 2 Drawing Sheets

BI-LAYER TIP CAP

TECHNICAL FIELD

The present invention relates generally to a turbine engine and more particularly relates to a bi-layer tip cap for a turbine bucket.

BACKGROUND OF THE INVENTION

In a gas turbine engine, air is pressurized in a compressor and then mixed with fuel and ignited in a combustor for generating hot combustion gases. The gases flow through turbine stages that extract energy therefrom for powering the compressor and producing useful work. A turbine stage includes a row of turbine buckets extending outwardly from a supporting rotor disc. Each turbine bucket includes an airfoil over which the combustion gases flow. The airfoils are generally hollow and may be provided with air bled from the compressor for use as a coolant during operation.

Each turbine bucket includes a blade body and a tip cap. Due to the environment in which the tip cap operates, the tip cap should be oxidant resistant. The tip cap also is prone to bulging due to creep. Most alloys with sufficient creep strength do not have sufficient resistance to oxidation. Most alloys with adequate oxidation resistance do not have sufficient creep strength. Those alloys that do have adequate properties for both creep and oxidation generally are not available except as custom cast billets. Such custom billets then have to be worked at great expense to form a finished product. Other alternatives include the use of an aluminized coating to the underside of the tip cap.

Thus, there is a desire for a suitable material that provides both adequate oxidation resistance and sufficient creep strength. Preferably, the material should be reasonable in terms of costs and workability.

SUMMARY OF THE INVENTION

The present application thus describes a tip cap for use in a turbine bucket. The tip cap may include a shield of an oxidant resistant material and a cap positioned within the shield of a high strength material.

The oxidant resistant material may be a nickel-based alloy or a cobalt-based alloy. The shield may have a thickness of about 0.001 to about 0.030 inches (about 0.025 to about 0.762 millimeters). The high strength material may be a nickel-based alloy or a cobalt-based alloy. Specifically, the high strength material may include a precipitation-strengthened, creep resistant super alloy. The cap may have a thickness of about 0.030 to 0.120 inches (about 0.762 to about 3 millimeters).

The shield may have a cup shape and the cap fits within the shield. The shield also may be a flat plate and cap may be attached to the shield. The shield may be a powder deposited on the cap. The shield may be attached to the cap via welding, brazing, or mechanical attachment.

The present application further described a turbine bucket. The turbine bucket may include an airfoil and a tip cap positioned within the airfoil. The tip cap may include an oxidant resistant shield and a high strength cap.

The oxidant resistant shield may include a nickel-based alloy or a cobalt-based alloy. The oxidant resistant shield may have a thickness of about 0.001 to about 0.030 inches (about 0.025 to about 0.762 millimeters). The high strength cap may include a nickel-based alloy or a cobalt-based alloy. The high strength cap may include a thickness of about 0.030 to 0.120 inches (about 0.762 to about 3 millimeters). The high strength cap may include a precipitation-strengthened, creep resistant super alloy.

These and other features of the present invention will become apparent to one of ordinary skill in the art upon review of the following detailed description of the preferred embodiments when taken in conjunction with the drawings and the appended claims.

DETAILED DESCRIPTION

Figure 1:
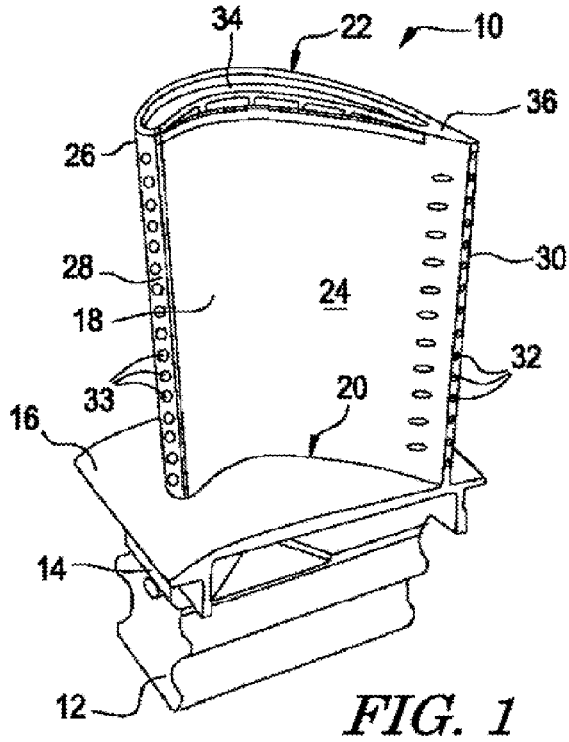
FIG. 1 is a perspective view of a turbine bucket for use herein.

Referring now to the drawings, in which like numerals refer to like parts throughout the several views, FIG. 1 depicts an example of a turbine bucket 10. The turbine bucket 10 may include a conventional dovetail 12. The dovetail 12 attaches to a conventional rotor disc (not shown). A blade shank 14 extends upwardly from the dovetail 12 and terminates in a platform 16 that projects outwardly from and surrounds the shank 14.

A hollow airfoil 18 extends outwardly from the platform 16. The airfoil 18 has a root 20 at the junction with the platform 16 and a tip 22 at its outer end. The airfoil 18 has a concave pressure sidewall 24 and a convex suction sidewall 26 joined together at a leading edge 28 and a trailing edge 30. The airfoil 18 may include a number of trailing edge cooling holes 32 and a number of leading edge cooling holes 33. A tip cap 34 may close off the tip 22 of the airfoil 18. A squealer tip 36 may extend outwardly from the tip cap 34.

The airfoil 18 may take any configuration suitable for extracting energy from the hot gas stream and causing rotation of the rotor disc. The airfoil 18 described herein is for the purpose of example only. The present application is not intended to be limited to this airfoil embodiment. The airfoil 18 may be used in a stage one bucket of a turbine manufactured by General Electric Corporation of Schenectady, N.Y. or in similar types of devices.

Figure 2:
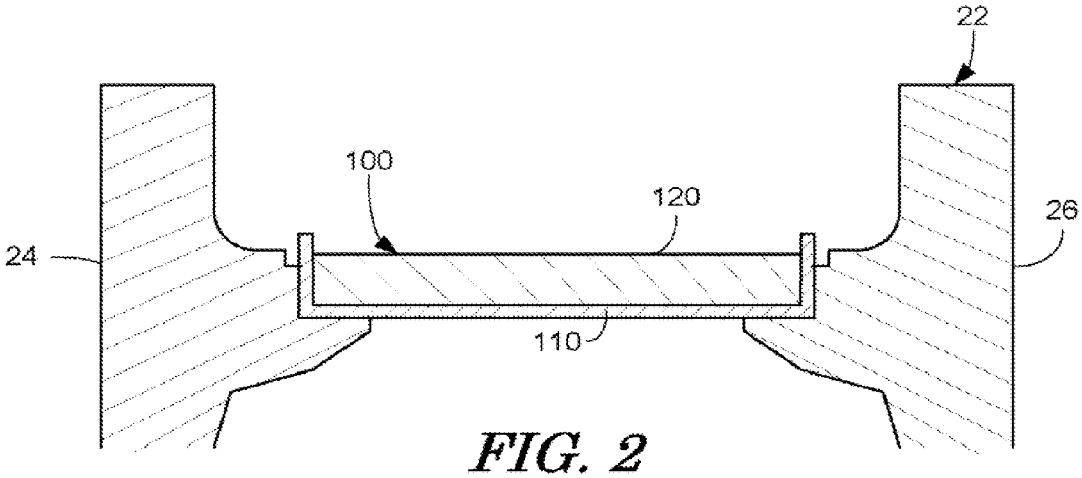
FIG. 2 is a side cross-sectional view of a bi-layer tip cap as is described herein.
Figure 3:
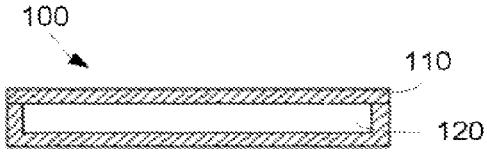
FIG. 3 is a cross-sectional view of an alternative embodiment of the bi-layer tip cap described herein.
Figure 4:
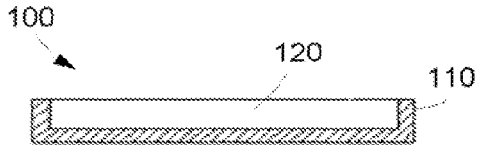
FIG. 4 is a cross-sectional view of an alternative embodiment of the bi-layer tip cap described herein.
Figure 5:
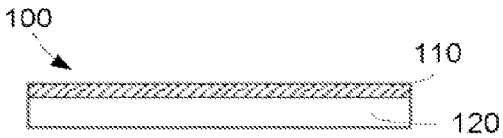
FIG. 5 is a cross-sectional view of an alternative embodiment of the bi-layer tip cap described herein.
Figure 6:
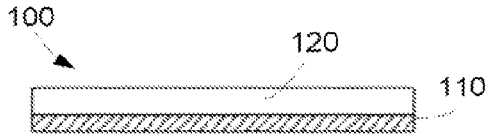
FIG. 6 is a cross-sectional view of an alternative embodiment of the bi-layer tip cap described herein.
Figure 7:
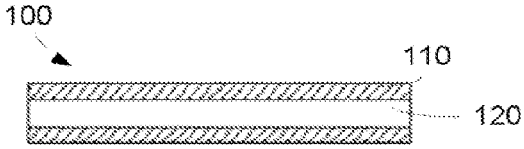
FIG. 7 is a cross-sectional view of an alternative embodiment of the bi-layer tip cap described herein.

FIG. 2 shows a tip cap 100 as is described herein. As is shown, the tip cap 100 is positioned within the tip 22 of the airfoil 18 between the sidewalls 24 and 26. The tip cap 100 may be of two-piece construction and may include a shield 110 and a cap 120.

The shield 110 is an oxidation shield. The shield 110 may be made from an oxidant resistant material such as nickel-based alloys or cobalt-based alloys with additives of aluminum, silicon, lanthanum or other oxidation-resistant additives. An alloy such as a Haynes 230 alloy may be used. The shield 110 may come as a sheet material, a powder, a wire, a plating material, or other types of compositions. The shield 110 may be used as a flat plate, as cladding material, or the shield 110 may be formed into a cup. If formed into a cup, the cup may be performed in isolation or be formed around the cap 120. The shield may have a thickness of about 0.001 to about 0.030 inches (about 0.025 to about 0.762 millimeters).

The cap 120 may come as a sheet or as a forged or a cast material. The cap 120 may be made from a nickel-based or cobalt-based gamma-prime strengthened alloy. A Nimonic 263 alloy material may be used. The material has high strength and corrosion resistance and may exhibit good formability. Other types of high strength materials or compositions may be used herein. By high strength materials, we mean materials that are strain tolerant. Precipitation-strengthened, creep resistant super alloys are preferred.

The cap 120 may have a thickness of about 0.030 to 0.120 inches (about 0.762 to about 3 millimeters). The cap 120 may be sized to fit within the shield 110 and the bucket tip 22 of the airfoil 18. Any desired size may be used herein. The cap 120 may be wire cut, water jet cut, or laser cut. The cap 120 also may be cut mechanically via stamping, shearing, or milling. Other types of manufacturing methods may be used herein.

As is shown in FIGS. 3-7 the shield 110 may be attached to one (1), two (2), three (3), or all four (4) sides of the cap 120. The shield 110 and the cap 120 may be assembled together and resistance welded to form a single composite tip cap 100. Other forms of welding or brazing may be used. The shield 110 may extend around the edge of the cap 120 to form a ductile layer to facilitate crack free welding. The tip cap 100 may be welded, brazed or mechanically attached to the sidewalls 24, 26 in a conventional manner. Additionally, the shield 110 may be deposited as a filler material or plating material to the cap 120 in a cladding operation. If the shield 110 is a powder, it may be deposited directly on the cap 120 or it may be weld built by using filler wire, by electroplating, by diffusing a braze perform, or via plasma spray. Other types of manufacturing methods also may be used herein.

The tip cap 100 thus employs the shield 110 with higher oxidation resistance and somewhat lower strength with the cap 120 that provides high strength but somewhat lower oxidation resistance. The combination of these characteristics eliminates the need to use more exotic tip materials. The combination also eliminates the need to apply an aluminized coating to the underside or to the topside of the tip cap 100 after welding so as to reduce both the costs and time doing repairs and/or refurbishment.

It should be apparent that the foregoing relates only to the preferred embodiments of the present invention and that numerous changes and modifications may be made herein without departing from the general spirit and scope of the invention as defined by the following claims and the equivalents thereof.

What is claimed is:

1. A turbine bucket, comprising:

a tip cap;

wherein the tip cap comprises:

a shield;

the shield comprising an oxidant resistant material and a cup shape; and a cap;

the cap comprising a high strength material; and wherein the cap fits within the shield; and a squealer tip positioned about the tip cap.

2. The turbine bucket of claim 1, wherein the oxidant resistant material comprises a nickel-based alloy or a cobalt-based alloy.

3. The turbine bucket of claim 1, wherein the high strength material comprises a nickel-based alloy or a cobalt-based alloy.

4. The turbine bucket of claim 1, wherein the shield comprises a thickness of about 0.001 to about 0.030 inches (about 0.025 to about 0.762 millimeters).

5. The turbine bucket of claim 1, wherein the cap comprises a thickness of about 0.030 to 0.120 inches (about 0.762 to about 3 millimeters).

6. The turbine bucket of claim 1, wherein the shield comprises a flat plate and wherein the cap is attached to the shield.

7. The turbine bucket of claim 1, wherein the shield comprises a powder and wherein the powder is deposited on the cap.

8. The turbine bucket of claim 1, wherein the shield is attached to the cap via welding, brazing, or mechanical attachment.

9. The turbine bucket of claim 1, wherein the high strength material comprises a precipitation-strengthened, creep resistant super alloy.

10. The turbine bucket of claim 1, wherein the cap comprising a nonabradable material.

11. A turbine bucket comprising:

an airfoil;

a tip cap positioned within the airfoil;

wherein the tip cap comprises an oxidant resistant shield and a high strength cap; and wherein the high strength cap fits within the oxidant resistant shield; and a squealer tip positioned about the tip cap.

12. The turbine bucket of claim 11, wherein the oxidant resistant shield comprises a nickel-based alloy or a cobalt-based alloy.

13. The turbine bucket of claim 11, wherein the high strength cap comprises a nickel-based alloy or a cobalt-based alloy.

14. The turbine bucket of claim 11, wherein the oxidant resistant shield comprises a thickness of about 0.001 to about 0.030 inches (about 0.025 to about 0.762 millimeters).

15. The turbine bucket of claim 11, wherein the high strength cap comprises a thickness of about 0.030 to 0.120 inches (about 0.762 to about 3 millimeters).

16. The turbine bucket of claim 11, wherein the high strength cap comprises a precipitation-strengthened, creep resistant super alloy.

17. The turbine bucket of claim 11, wherein the high strength cap comprising a nonabradable material.

* * * * *